United States Patent [19]

Marshall, Jr. et al.

[11] 4,435,794

[45] Mar. 6, 1984

[54] WALL-DRIVEN OVAL RING TRANSDUCER

[75] Inventors: William J. Marshall, Jr.; Gerald A. Brigham, both of Nashua, N.H.

[73] Assignee: Sanders Associates, Inc., Nashua, N.H.

[21] Appl. No.: 280,749

[22] Filed: Jul. 6, 1981

[51] Int. Cl.[3] ..... H04R 17/00

[52] U.S. Cl. ..... 367/155; 310/330; 310/337; 367/159; 367/160

[58] Field of Search ..... 367/153, 155, 157, 159, 367/160, 161, 163, 165, 168, 174, 175, 156; 310/330, 331, 337

[56] References Cited

U.S. PATENT DOCUMENTS

| | | | |
|---|---|---|---|
| 2,425,594 | 8/1947 | Brown | 367/163 |
| 3,139,603 | 6/1964 | Church et al. | 367/155 |
| 3,258,738 | 6/1966 | Merchant | 367/163 |
| 3,274,537 | 9/1966 | Toulis | 367/163 |
| 3,277,433 | 10/1966 | Toulis | 367/163 |
| 3,370,187 | 2/1968 | Straube | 367/161 |
| 3,706,967 | 12/1972 | Renna, Jr. | 367/159 |
| 3,846,744 | 5/1974 | Renna, Jr. et al. | 367/159 |
| 4,384,351 | 5/1983 | Paglearini, Jr. et al. | 367/153 |

*Primary Examiner*—Harold J. Tudor

*Attorney, Agent, or Firm*—Louis Etlinger; Donald A. Streck

[57] ABSTRACT

This invention is a small light weight underwater transducer that operates at low frequencies. The foregoing is accomplished by embedding piezoelectric material in the wall of an oval shell between the shell's nodal points. When an alternating voltage is applied to the piezoelectric material, the piezoelectric material expands and contracts causing large circumferential strains in the shell of the transducer. The aforementioned strains cause the shell to vibrate and energy to be radiated into the water. This invention may also be used as a receiving type of transducer.

10 Claims, 4 Drawing Figures

WALL-DRIVEN OVAL RING TRANSDUCER

FIELD OF THE INVENTION

This invention relates to electro-mechanical transducers and more particularly to a wall-driven oval ring transducer that has piezoelectric material or the like imbedded in the wall of the transducer shell so that when the material is excited the transducer shell will vibrate.

BACKGROUND OF THE INVENTION

Underwater sound transducers are devices that detect or generate and radiate sound in water to determine the location of objects in the water or for purposes of communication. The transducer converts electric energy into acoustic energy or acoustic energy into electrical energy.

One type of transducer utilized by the prior art is a flextensional transducer. Flextensional transducers have wider bandwidths, lower operating frequencies and higher power handling capabilities than other types of transducers of comparable size. A flextensional transducer has a flexible outer shell or housing which is excited by a piezoelectric or piezomagnetic transducer stack or driving element that is driven in a length expander mode. The stack is placed in compression between opposing interior walls of the shell. The elongation and contraction of the stack imparts a motion to the shell which, in general, radiates or couples energy into the water.

As submarines become quieter and the background noises of the ocean increase due to increased commerce, it becomes more and more difficult to locate foreign submarines by means of passive detection. One means to detect quieter running submarines in a noisier environment is to use active sonar systems (projectors and receivers). In most applications to construct the transducer so that it will be as small as possible, i.e., in an active towed array the transducer should be small and light in weight so that it will have low drag and not sink and array. Thus, it is apparent that there is a need for a smaller, lighter in weight, more efficient underwater sound transducer that may be used at very low frequencies.

SUMMARY OF THE INVENTION

This invention provides a new and improved small, lightweight, efficient underwater sound transducer that operates at low frequencies. The apparatus of this invention accomplishes the foregoing by imbedding a piezoelectric or the like in certain regions of the wall of an oval shell. When an alternating voltage is applied to the piezoelectric material, the material will expand and contract causing large circumferential strains in the shell of the transducer. The aforementioned strains will cause the shell to flex or vibrate. The vibration of the shell causes energy to be radiated into the water.

One of the many uses in which the apparatus of this invention may be used is in a target simulator. A target simulator is a type of training device that produces sounds which mimic the sound of ships or submarines. When the correct voltage inputs are applied to the piezoelectric material contained within the wall-driven oval ring transducer of this invention, the walls of the transducer vibrate and produce sounds that sound like ships or submarines. A wall-driven oval ring transducer is contained within a target simulator. The target simulator is then placed in some submersible vehicle similar to a torpedo. When this vehicle moves through the water the apparatus of this invention sounds like a submarine; thus, operators of underwater listening devices and their crews aboard ships and aeroplanes may try to locate the target simulator(s). Prior art transducers could not be used satisfactorily in target simulators because of their large size and high power requirements. The typical submersible vehicle only has a small amount of space for the sound generating source and batteries and a target simulator should have a long operating life.

The size and weight of the apparatus of this invention is also very important when a ship or boat is used to tow an array that includes a plurality of wall-driven oval ring transducers. The small size and light weight of the aforementioned transducer make it easier to deploy and recover. It is also easier for the ship to move the transducer through the water, since there is less mass for the ship to move. Due to its small size and the weight of the transducers, the array will also produce less flow noise when it is being towed through the water. Because of its small size and light weight the wall-driven oval ring transducer may also be deployed by helicopter whereas prior art transducers were too large and heavy to be deployed by helicopter.

The above examples have illustrated applications of the wall-driven oval ring transducer of this invention being used as an active transducer; however, the wall-driven oval ring transducer may also be used as a passive transducer.

It is an object of this invention to provide a new lightweight, small, efficient underwater transducer that operates at very low frequencies.

It is a further object of this invention to excite an oval cylinder into flexural vibration by exciting a piezoelectric material that is embedded in the walls of the transducer.

Other objects and advantages of this invention will become apparent as the following description proceeds, which description should be considered together with the accompanying drawings.

DESCRIPTION OF A PREFERRED EMBODIMENT

Figure 1:
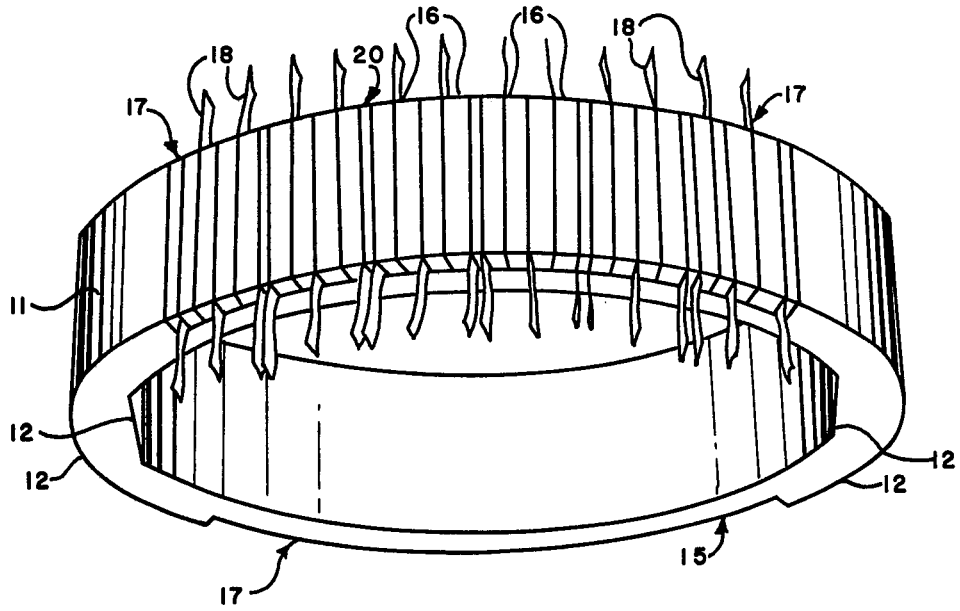
FIG. 1 is a perspective representation of a partially built wall-driven oval ring transducer.

Referring now to the drawings in detail, and more particularly to FIG. 1, the reference character 11 represents the shell or ring of a wall-driven oval ring transducer 15. Shell 11 is an oval cylinder with slightly thickened walls near the major axes, region 12. The depth capability and frequency performance of the aforementioned transducer may be modified by adding or removing material from region 12 (region of shell 11 near the major axis) of sheel 11. Thinning region 12 lowers the fundamental frequency or depth capability (transducer 15 will be able to survive less depth, hence, it will not function at increased depths) of transducer 15. In the event additional material is added to region 12 the fundamental frequency and depth survivability of transducer 15 will increase.

The description of the preferred embodiment hereinafter is with reference to the use of piezoelectric material. Those skilled in the art will recognize that piezomagnetic material or the like could be substituted therefore within the spirit and scope of the present invention.

A pair of piezoelectric stacks 20 that comprise a plurality of ceramic plates 16 that have alternating polarities are placed in cut-out regions 17. Regions 17 are on opposite sides of shell 11. One piezoelectric stack 20 is shown placed in one of the regions 17 and, for illustrative purposes, the other region 17 is shown before the other piezoelectric stack 20 is placed therein. The aforementioned piezoelectric stacks are constructed by glueing a plurality of ceramic plates 16 and metal electrodes 18 together on a form that has the same radius of curvature as region 17. The polarities of adjacent plates 16 are reversed from one another and electrodes 18 are placed between plates 16 in such a manner that the electrodes being connected to the negative plates 16 will protrude from one side of wall 11 and the electrodes 18 being connected to the positive plates 16 will protrude from the opposite side of wall 11. The positively coupled electrodes are wired or soldered together and the negatively coupled electrodes are wired or soldered together (not shown) and these electrodes are respectively coupled to the positive and negative terminals (not shown) of the amplifier.

Figure 2:
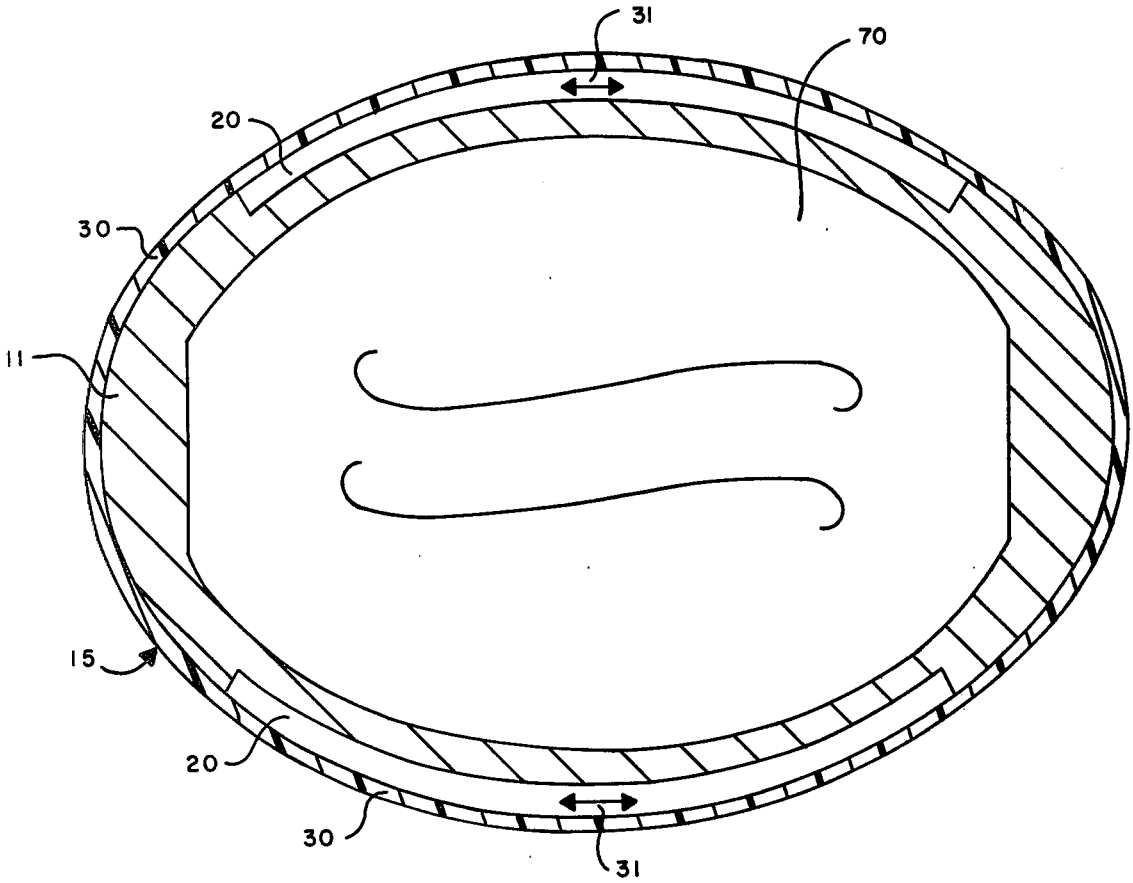
FIG. 2 is a top view of a wall-driven oval ring transducer.

FIG. 2 is a top view of transducer 15, symbolically indicating wires 25. One end of wires 25 is connected to the positive and negative inputs of an amplifier (not shown) and the other end of wires 25 is connected to electrodes 18 (shown in FIG. 1). The aforementioned amplifier may be located within dual cavity 70 of transducer 15. Piezoelectric stacks 20 are held within the cut-out regions of shell 11 by means of a coating 30. Coating 30 comprises a plurality of glass fibers that are embedded in an epoxy material which is tightly wound around shell 11. Hence, coating 30 help keep stack 20 in place and applies some circumferential prestress to stacks 20.

While transducer 15 is submerged in water and vibrating near the operating frequency of transducer 15, there are four positions or nodes around the circumference of shell 11 that are essentially motionless. The four nodal positions are near the end of the region in which piezoelectric stacks 20 are placed. The criteria for determining the region in which stacks 20 are placed are related to the coupling coefficient of transducer 15. Piezoelectric stacks 20 are placed in the regions that will maximize the coupling coefficient, namely region 17 in FIG. 1. The coupling coefficient is a parameter of electroacoustic devices that is related to the maximum power handling capability and the bandwidth of the transducer; in essence, it is a general quality factor for transducers. By maximizing the coupling coefficient, i.e., the power handling capability and useable bandwith, we maximize the range of frequencies where the transducer will transmit energy efficiently.

When a voltage is applied to stack 20, the ceramic plates that comprise stack 20 expand in a circumferential direction as shown by arrows 31. Each of the aforementioned ceramic plates moves further from other and causes the inert material that comprise shell 11 to move. Shell 11 has a flexural type of motion which causes soundwaves to be generated in the water so that transducer 15 is an active type of transducer. In the event one wanted transducer 15 to be a passive type of transducer, as well known by those skilled in the art electrode 18 (shown in FIG. 1) would be connected to the terminals of a driven amplifier that operated in the opposite direction of the driving amplifier (not shown); that is in response to acoustic excitation. In that case shell 11 would vibrate in response to acoustical energy causing a voltage to be produced in piezoelecric stacks 20, which would then be amplified by the driven amplifier.

Figure 3:
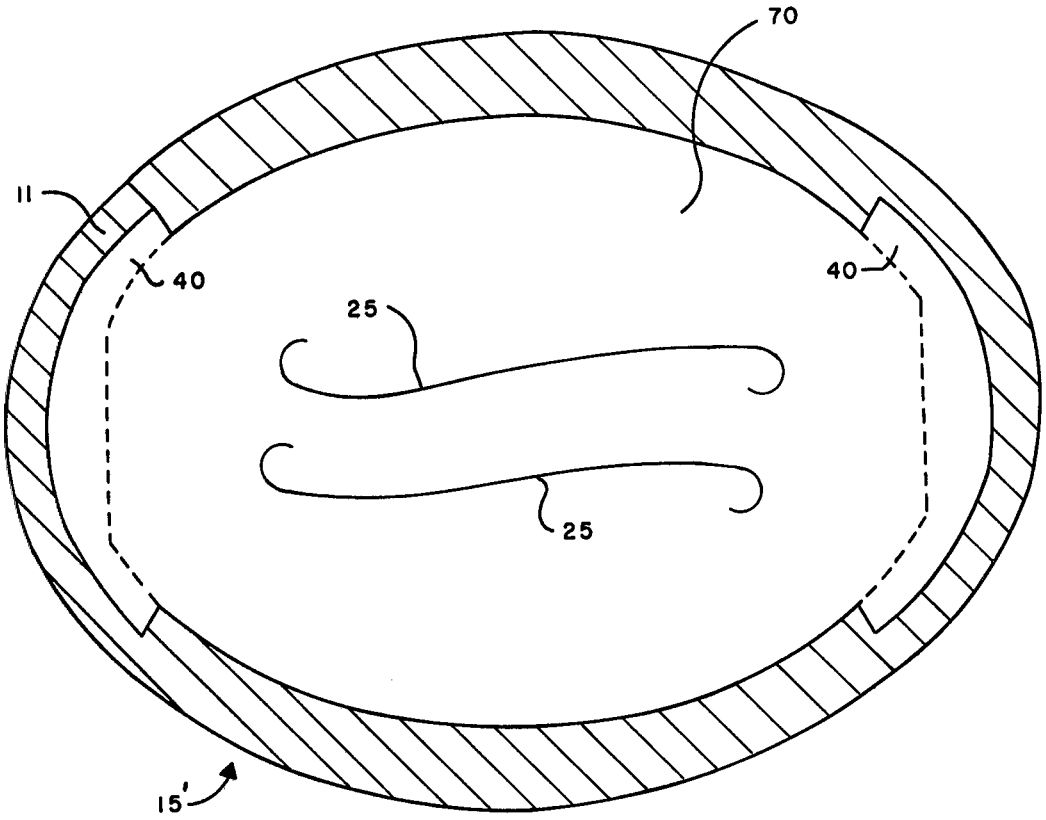
FIG. 3 is a top view of a wall-driven oval ring transducer showing the piezoelectric material placed in a different region of the wall of the transducer.

FIG. 3 is a top view of an alternate embodiment of transducer 15'wherein piezoelectric stacks 20 are embedded in a different region of wall 11. Wires 25 are connected to the positive and negative terminals of an amplifier (not shown) and electrodes 18. Piezoelectric stacks 20 (not shown) are held in region 40 by means of the concave geometry of shell 11. When a voltage is applied to stacks 20, the ceramic plates that comprise stacks 20 expand in a circumferential direction. Each of the aforementioned ceramic plates moving further from each other and causes the inert material that comprises shell 11 to move. Thus, piezoelectric stacks 20 drive shell 11 in a flexural mode of vibration.

Figure 4:
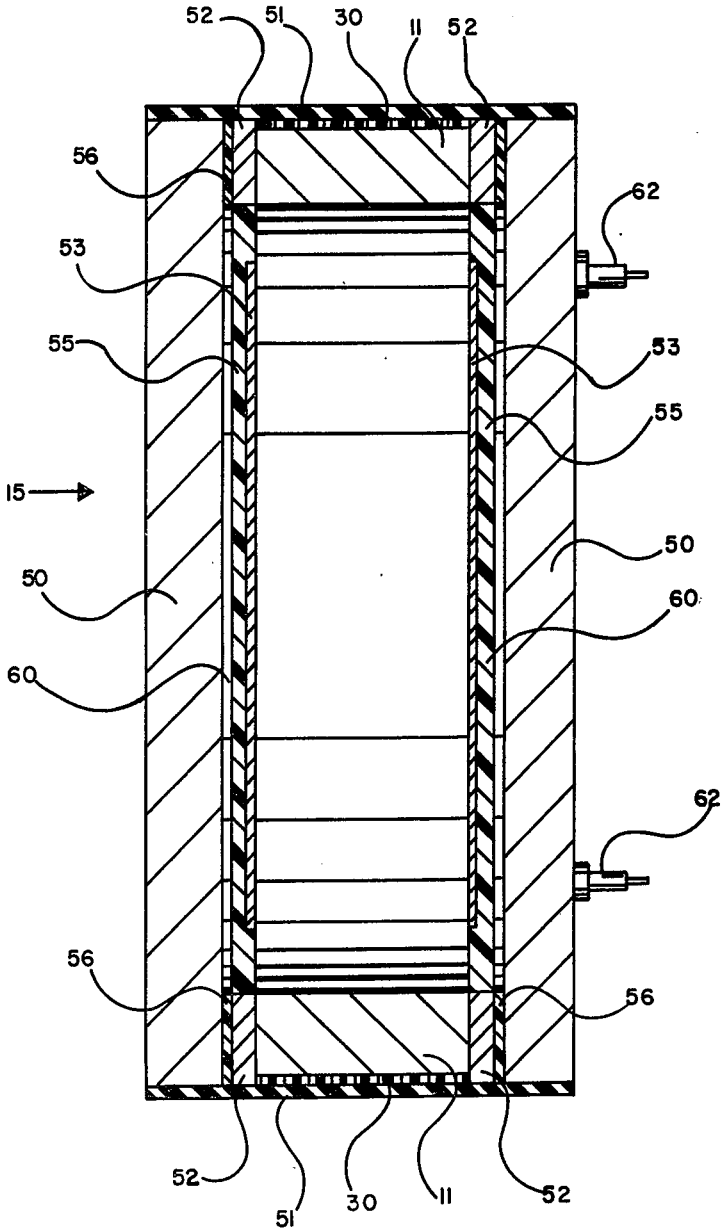
FIG. 4 is a cross-sectional view of a fully assembled wall-driven oval ring transducer.

FIG. 4 is a cross-sectional view of the transducer depicted in FIGS. 1 and 2 showing the addition of flanges and a boot to create a watertight transducer. The open ends of shell 11 with coatings 30 affixed thereto are partially closed by shell extension 52 and flanges or fixed plates 50. Flanges 50 are connected to shell extension 52 and shell 11 by bonded corprene gaskets or pads 56. Bonded corprene 56 is used to create air gaps 60 so that vibrating shell 11 is isolated from fixed flanges 50. Elastomeric boots 51 are coupled to flanges 50 to ensure that the aforementioned transducer will not contain water. Wires 53 that are coupled to waterproof connector 62 are held in place next to piezoelectric stack 20 by means of an epoxy potting 55.

The above specification describes a new and improved transducer. It is realized that the above description may indicate to those skilled in the art additional ways in which the principles of this invention may be used without departing from its spirit. It is, therefore, intended that this invention be limited only by the scope of the appended claims.

What we claim is:

1. A wall-driven oval ring transducer comprising:

(a) an oval cylindrical shell comprised of walls having a thickness with inner and outer side walls and having major and miner axes in cross-section and being symmetrical about said axes, the thickness of said walls in two opposed regions having said major axis passing therethrough being sized in relationship to the thickness of said walls in two opposed regions having said minor axis passing therethrough so as to place the fundamental frequency of the transducer at a preselected level; and, (b) extension means disposed circumferentially within a pair of cut out sections in opposed portions of said walls and connectable to a source of a driving signal for simultaneously applying an outward flexing force to said walls in said regions having said minor axis passing therethrough.

2. The transducer of claim 1 wherein:

(a) said extension means comprises a pair of stacks of piezoelectric crystals disposed in respective ones of said cut out sections; and, (b) said cut out sections are in respective ones of said outer side walls of said shell in areas having said minor axis passing therethrough.

3. The transducer of claim 2 and additionally comprising:

means disposed about said outer sidewalls of the shell and said stacks for holding said stacks within said cut out sections and for applying a circumferential prestress to said stacks.

4. The transducer of claim 1 wherein:

(a) said extension means comprises a pair of stacks of piezoelectric crystals disposed in respective ones of said cut out sections; and, (b) said cut out sections are in respective ones of said inner sidewalls of said shell in areas having said major axis passing therethrough.

5. A wall-driven transducer comprising:

(a) a oval cylindrical shell being symmetrical in cross-section about major and minor axes and having walls including a pair of elongated opposed sidewalls with inner and outer surfaces and having said minor axis passing therethrough;

(b) extension means disposed within cut out sections in respective ones of said elongated opposed sidewalls and connectable to a driving signal source for simultaneously applying an outward flexing force to said elongated opposed sidewalls; and, (c) means for applying an inward prestress to said extension means.

6. The transducer of claim 5 wherein:

(a) said extension means comprises a pair of stacks of piezoelectric crystals disposed in respective ones of said cut out sections;

(b) said cut out portions are disposed in said outer surface of said elongated opposed sidewalls.

7. The transducer of claim 6 wherein:

said prestress means comprises a plurality of fibers that are embedded in an epoxy-like material and which are tightly wound circumferentially around said shell and said stacks to both apply a circumferential prestress to said stacks and hold said stacks in said cut out sections.

8. The transducer of claim 5 wherein:

the wall thickness of said shell in said two opposed elongated sidewalls is sized in relationship to the wall thickness of said shell in remaining portions thereof between said elongated sidewalls so as to place the fundamental frequency of the transducer at a preselected level.

9. The transducer of claim 8 wherein:

the wall thickness of said remaining portions is reduced relative to the wall thickness of said opposed elongated sidewalls whereby said fundamental frequency is lowered.

10. A wall-driven oval ring transducer comprising:

(a) an oval cylindrical shell comprised of walls having inner and outer sidewalls and having major and minor axes in cross-section, being symmetrical about said axes, and having cut out sections in said outer sidewalls of said walls of said shell in two areas having said minor axis passing therethrough;

(b) a pair of stacks of piezoelectric crystals disposed in respective ones of said cut out sections and including means for connecting said crystals to a source of a driving signal; and, (c) a plurality of fibers embedded in an epoxy-like material tightly wrapped circumferentially around said outer sidewalls of said shell and said stacks to hold said stacks in said cut out sections and to circumferentially prestress the transducer.

* * * * *